US006390180B1

(12) United States Patent
Olsen

(10) Patent No.: US 6,390,180 B1
(45) Date of Patent: May 21, 2002

(54) HEAT EXCHANGER ISOLATION DEVICE

(76) Inventor: Mark W. Olsen, 2219 Carmel, Carrollton, TX (US) 75006

( * ) Notice: Subject to any disclaimer, the term of this patent is extended or adjusted under 35 U.S.C. 154(b) by 0 days.

(21) Appl. No.: 09/459,197

(22) Filed: Dec. 10, 1999

(51) Int. Cl.[7] ..... F28F 9/007; F28F 19/00; F28F 13/00

(52) U.S. Cl. ..... 165/67; 165/126; 165/125; 165/134.1; 165/135; 165/149

(58) Field of Search ..... 165/67, 76, 124, 165/125, 126, 135, 134.1, 149

(56) References Cited

U.S. PATENT DOCUMENTS 3,232,338 A * 2/1966 Pierce ..... 165/67
4,078,396 A * 3/1978 Penizotto et al. ..... 165/76 X
4,231,421 A * 11/1980 Eaton et al. ..... 165/125 X
4,306,615 A * 12/1981 Bolton et al. ..... 165/67
4,330,030 A * 5/1982 Cate ..... 165/67
4,492,269 A * 1/1985 Jennings et al. ..... 165/125 X
4,519,467 A * 5/1985 Saunders ..... 165/67 X
4,763,723 A * 8/1988 Granetzke ..... 165/67
5,066,194 A * 11/1991 Amr et al. ..... 165/125 X
5,325,914 A * 7/1994 Tanaka ..... 165/67
6,182,745 B1 * 2/2001 Potier ..... 165/134.1 X

* cited by examiner

*Primary Examiner*—Leonard Leo
(74) *Attorney, Agent, or Firm*—W. Kirk McCord

(57) ABSTRACT

In a space conditioning system, such as a central air conditioning or heat pump system, a unit of the system has a heat exchanger made of a predetermined first type of metal (e.g., aluminum) and a cabinet in which the heat exchanger is mounted, which is made of a second type of metal (e.g., steel). A device is provided for isolating the heat exchanger from the cabinet to prevent contact therebetween. The isolation device preferably includes plural snap-fit plastic members spaced along the top and bottom of the heat exchanger, plural mounting brackets made of the first type of metal on each end of the heat exchanger and a pair of plastic bushings operatively associated with each mounting bracket and extending through aligned holes in the corresponding mounting bracket. The bushings are adapted to receive an attachment member, such as a screw, made of the second type of metal, so that each attachment member extends through the bushings and aligned holes in the corresponding mounting bracket to attach the mounting bracket to the cabinet without the mounting bracket contacting any part of the cabinet or the attachment member. In preventing direct contact between components having dissimilar metals, corrosion due to galvanic action is effectively inhibited.

11 Claims, 3 Drawing Sheets

HEAT EXCHANGER ISOLATION DEVICE

DESCRIPTION

1. Field of Invention

This invention relates to heat exchangers used in space conditioning systems, such as air conditioners and heat pumps, and in particular to a device for preventing direct contact between a heat exchanger made of a first type of metal and a cabinet in which the heat exchanger is located and which is made of a second type of metal.

2. Background Art

In one type of space conditioning system known as a central air conditioning system, the system is comprised of an indoor unit and an outdoor unit. The indoor unit includes a first heat exchanger used as an evaporator for evaporating a phase change refrigerant and an air handler having a blower for blowing indoor air to be cooled across the first heat exchanger. The outdoor unit includes a second heat exchanger used as a condenser for condensing the vapor refrigerant evaporated in the first heat exchanger and a compressor for compressing the vapor refrigerant before it enters the second heat exchanger and for circulating refrigerant between the first and second heat exchangers.

Another type of space conditioning system known as a heat pump system also includes an indoor unit and an outdoor unit. Heat pump systems operate similar to the central air conditioning system described hereinabove, except that a heat pump system can be used for both cooling and heating. Both of the heat exchangers can function as an evaporator or a condenser, depending on whether the heat pump system is being operated in a heating or cooling mode. For example, if the heat pump system is being operated in a heating mode, the heat exchanger in the outdoor unit functions as an evaporator and the heat exchanger in the indoor unit functions as a condenser. If the heat pump system is being operated in the cooling mode, the heat exchanger in the indoor unit functions as an evaporator and the heat exchanger in the outdoor unit functions as a condenser.

According to prior practice, heat exchangers used in space conditioning systems typically include one or more refrigerant carrying copper tubes laced through plural relatively thin, aluminum fins. The tubes extend between steel inlet and outlet headers and the heat exchanger is mounted by attaching the steel headers to a steel cabinet or the like. Because the heat exchanger headers are made of the same material as the cabinet with which the heat exchanger is mounted, galvanic corrosion is normally not a major problem. However, other types of heat exchangers are known in the art that have application in space conditioning systems. Such other heat exchangers include so-called "parallel flow" heat exchangers in which both the tubes and headers are made of aluminum. The tubes are typically flat with relatively small hydraulic diameter flow paths inside each tube. When aluminum heat exchangers of this type are mounted with a steel cabinet, the dissimilar metals may result in unacceptable levels of galvanic corrosion in the heat exchanger. Therefore, there is a need to isolate the aluminum heat exchanger from the steel cabinet in which the heat exchanger is mounted, to prevent direct contact therebetween.

SUMMARY OF INVENTION

In accordance with the present invention, isolation means is provided for isolating a space conditioning system heat exchanger made of a predetermined first type of metal from a cabinet made of a predetermined second type of metal with which the heat exchanger is mounted. In accordance with a feature of the invention, the isolation means includes at least one first non-metallic member located on a top part of the heat exchanger to prevent contact between the heat exchanger and a top part of the cabinet and at least one second non-metallic member located on a bottom part of the heat exchanger to prevent contact between the heat exchanger and a bottom part of the cabinet. In accordance with another feature of the invention, the heat exchanger includes at least one mounting bracket made of the first type of metal and located on at least one end of the heat exchanger. The isolation means further includes at least one third non-metallic member interposed between the mounting bracket and an attachment member made of the second type of metal, which is used to mount the heat exchanger with the cabinet, to prevent direct contact between the attachment member and the bracket.

In the preferred embodiment, the first type of metal is aluminum and the second type of metal is steel. The first non-metallic member includes plural-snap fit plastic members spaced along the top part of the heat exchanger and the second non-metallic member also includes plural-snap fit plastic members spaced along a bottom part of the heat exchanger. The third non-metallic member preferably includes at least one plastic bushing adapted to extend between aligned holes in the mounting bracket. The bushing is adapted to receive the attachment member therethrough and prevents direct contact between the attachment member and the mounting bracket. Plural mounting brackets are preferably located on each end of the heat exchanger.

In accordance with the present invention, a device is provided for isolating a heat exchanger made of a first type of metal (e.g., aluminum) from a cabinet made of a second type of metal (e.g., steel) with which the heat exchanger is mounted. Corrosion due to galvanic action between dissimilar metals is effectively controlled by preventing direct contact between the heat exchanger and cabinet, while allowing the heat exchanger to be mounted in a fixed position within the cabinet.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
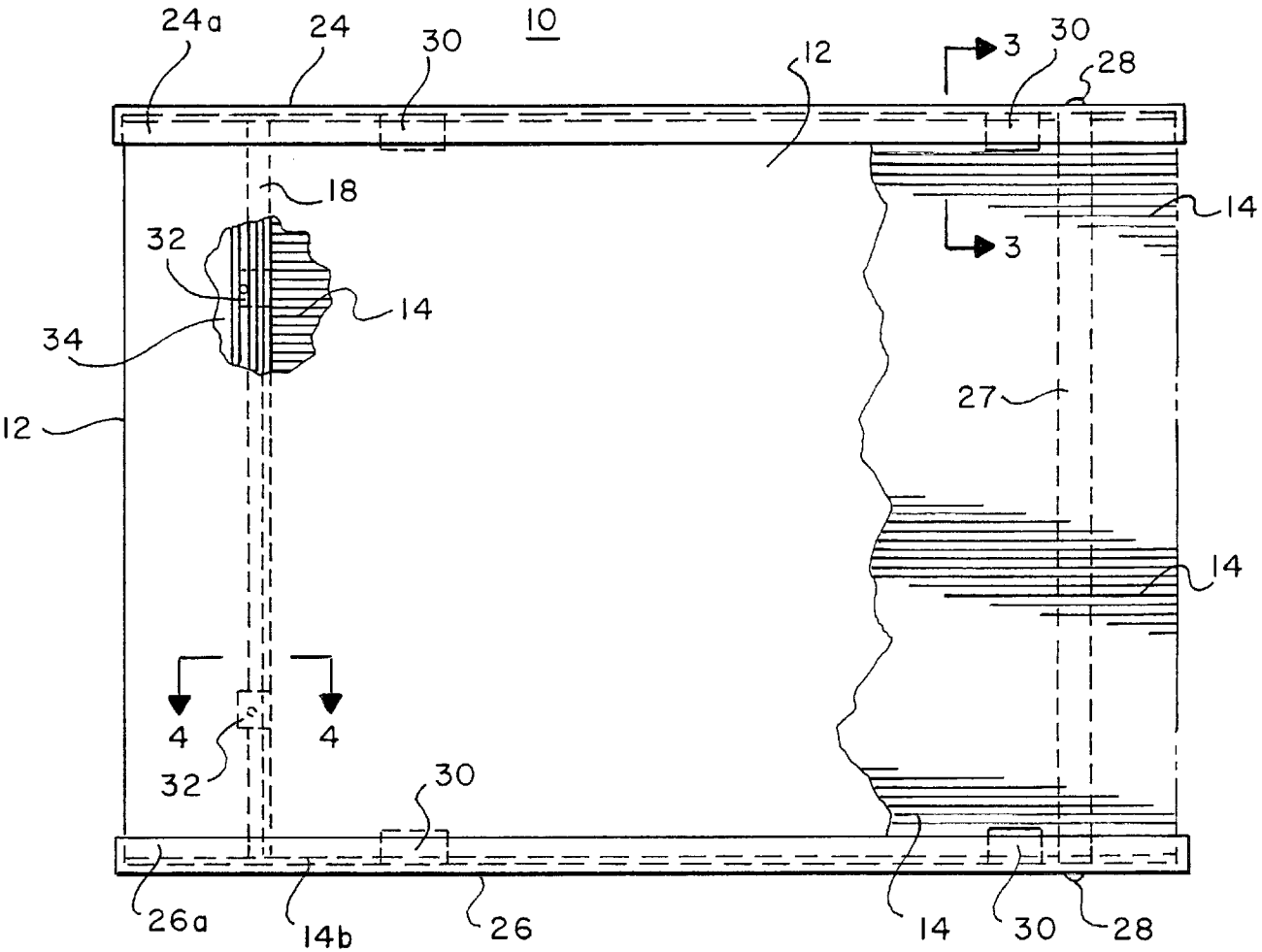
FIG. 1 is a side elevation view of an outdoor air conditioning unit, which is partially broken away to show a heat exchanger inside the unit and a device for isolating the heat exchanger from the unit cabinet.
Figure 2:
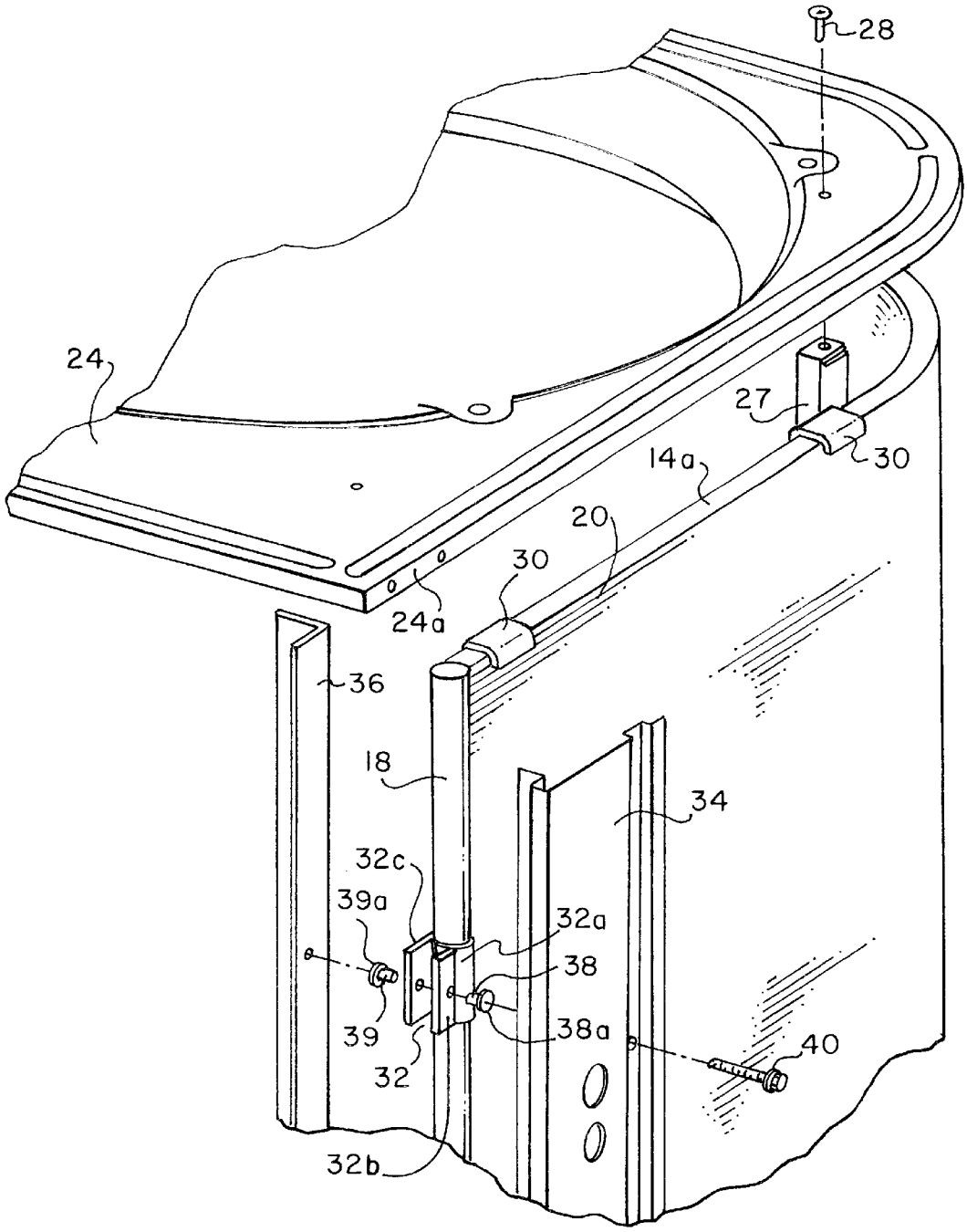
FIG. 2 is an exploded, partial perspective view of the unit of FIG. 1.
Figure 3:
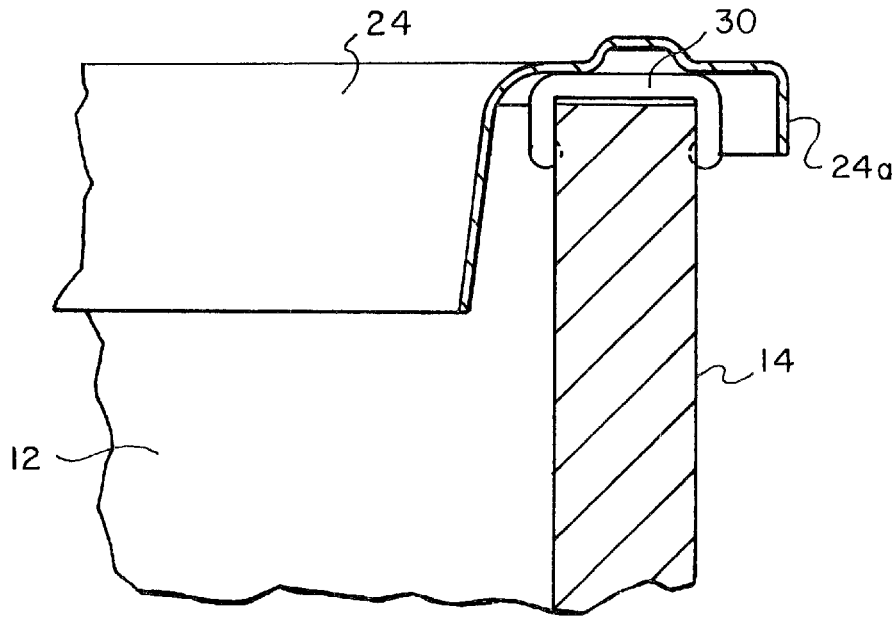
FIG. 3 is a sectional view, taken along the line 3—3 of FIG. 1.
Figure 4:
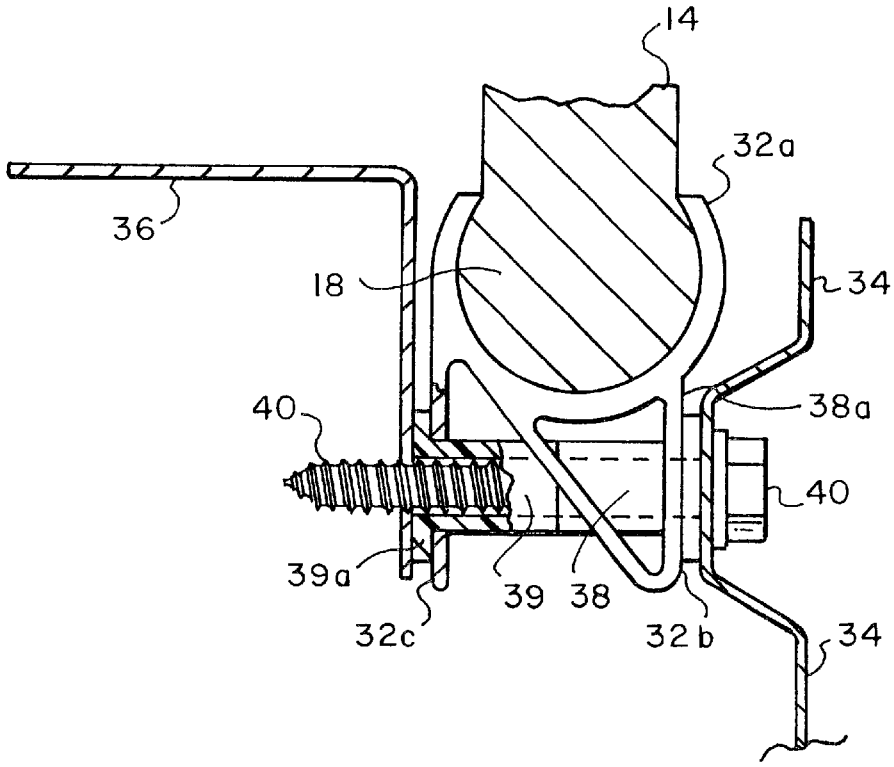
FIG. 4 is a sectional view, taken along the lien 4—4 of FIG. 1.

Referring to FIGS. 1 and 2, an outdoor unit 10, which is part of a space conditioning system, such as a central air conditioning or heat pump system, includes a cabinet 12 and a heat exchanger 14, which is housed within cabinet 12. Cabinet 12 is preferably in the shape of a generally rectangular prism. Heat exchanger 14 is preferably U-shaped with generally cylindrical headers 18 on each end thereof. Only one header 18 is shown is shown in FIGS. 1 and 2. One of the headers 18 is an inlet header and the other header 18 is an outlet header. Heat exchanger 14 further includes plural, relatively flat tubes 20 extending in parallel array between inlet and outlet headers 18. Each tube 20 preferably includes plural relatively small hydraulic diameter internal flow passages extending substantially the entire length of the corresponding tube 20 between inlet and outlet headers 18. Such relatively small hydraulic diameter flow paths are typically referred to as "microchannels".

Refrigerant or other heat transfer fluid enters heat exchanger 14 through inlet header 18, flows through tubes 20 and exits heat exchanger 14 through outlet header 18. Unit 10 also preferably also includes a fan (not shown) for blowing outdoor air across heat exchanger 14 to effect heat transfer between the outdoor air and the heat transfer medium fluid flowing within tubes 20. For example, if the heat transfer fluid is a phase change refrigerant, the outdoor air condenses the refrigerant in heat exchanger 14 in a central air conditioning system and in the cooling mode of a heat pump system and evaporates the refrigerant in heat exchanger 14 in the heating mode of a heat pump system.

The entire heat exchanger 14, including headers 18 and tubes 20, is preferably made of aluminum. Cabinet 12 is preferably made of steel. Therefore, metal-to-metal contact between aluminum heat exchanger 14 and steel cabinet 12 may result in galvanic corrosion, which can detract from the performance of outdoor unit 10 and reduce the life of the components thereof. In order to prevent metal-to-metal contact between cabinet 12 and heat exchanger 14, a device is provided in accordance with the present invention for isolating heat exchanger 14 from cabinet 12, while still allowing heat exchanger 14 to be mounted in a fixed position with cabinet 12. The assembly of unit 10 will now be described with reference to FIGS. 1–4.

Cabinet 12 has steel top and bottom panels 24 and 26. Top panel 24 has a downwardly projecting perimeter lip 24*a*, which overlaps a top part 14*a* of heat exchanger 14. Similarly, bottom panel 26 has an upwardly projecting perimeter lip 26*a*, which overlaps a bottom part 14*b* of heat exchanger 14. Top and bottom panels 24 and 26 are coupled together by means of plural steel support posts 27, which extend vertically between top and bottom panels 24 and 26. Each support post 27 is preferably configured as a U-shaped channel. Attachment screws 28 are used to connect top and bottom panels 24 and 26 to respective top and bottom portions of each support post 27, to secure top and bottom panels 24 and 26 in a fixed position with respect to each other.

In accordance with the present invention, plural plastic snap-fit members 30 are spaced along top part 14*a* and bottom part 14*b* of heat exchanger 14. Members 30 preferably have a U-shaped cross-section so that they overlap top and bottom portions 14*a* and 14*b*, as can be best seen in FIG. 2. After members 30 are positioned on heat exchanger 14, heat exchanger 14 is located within cabinet 12, such that lip 24*a* overlaps top part 14*a* and lip 26*a* overlaps bottom part 14*b*. Top panel 24 is in contact with snap-fit members 30 on top part 14*a* and bottom panel 26 is in contact with snap-fit members 30 on bottom part 14*b*. Members 30 effectively isolate aluminum heat exchanger 14 from steel top and bottom panels 24 and 26 of cabinet 12, to prevent metal-to-metal contact therebetween.

Heat exchanger 14 is secured to cabinet 12 by means of two aluminum mounting brackets 32, which are oven-brazed on each header 18. Each bracket 32 includes a generally semi-cylindrical portion 32*a* in which a corresponding header 18 is received and two ear portions 32*b*, 32*c* having respective holes in generally horizontal alignment, as can be best seen in FIG. 2. A steel mullion 34 and a steel, generally L-shaped steel mounting member 36 are provided to mount heat exchanger 14 with cabinet 12. As can be best seen in FIG. 2, mullion 34 and mounting member 36 have respective holes in generally horizontal alignment with the respective holes in ears 32*b*, 32*c* of each mounting bracket 32. However, because mullion 34 and mounting member 36 are made of steel and mounting brackets 32 are made of aluminum, mounting brackets 32 must be attached to mullion 34 and mounting member 36 without metal-to-metal contact therebetween.

In accordance with another aspect of the invention, two plastic bushings 38, 39 are provided to isolate mounting bracket 32 from mullion 34 and mounting member 36. Bushing 38 has a radially enlarged end portion 38*a* and bushing 39 has a radially enlarged end portion 39*b*. As can be best seen in FIG. 2, bushing 38 extends through the hole in ear 32*b* and bushing 39 extends through the hole in ear 32*c*, so that bushings 38, 39 are in horizontal alignment. Bushings 38, 39 have hollow centers to provide a horizontal passageway for an attachment screw 40. Screw 40 is preferably made of steel and extends through bushings 38, 39 and ears 32*b*, 32*c*, as can be best seen in FIG. 4. Radially enlarged portion 38*a* of bushing 38 is interposed between ear 32*b* and mullion 34 to prevent contact therebetween and radially enlarged portion 39*a* of bushing 39 is interposed between mounting member 36 and ear 32*c* to prevent contact therebetween. Similarly, the cylindrical portions of bushings 38, 39, which define the interior passageway through which attachment screw 40 extends, isolate the steel attachment screw 40 from the aluminum mounting bracket 32. Mullion 34 and mounting member 36 are attached to cabinet 12 in the conventional manner, whereby heat exchanger 14 is mounted with cabinet 12, but without metal-to-metal contact therebetween.

In accordance with the present invention, a device is provided for isolating a heat exchanger made of a first type of metal (i.e., aluminum) from a cabinet made of a second type of metal (i.e., steel) with which the heat exchanger is mounted, in an air conditioning or heat pump system. Therefore, components of an air conditioning unit can be made of dissimilar metals without the components being susceptible to galvanic corrosion.

The best mode for carrying out the invention has now been described in detail. Since changes in and/or additions to the above-described best mode can be made without departing from the nature, spirit or scope of the invention, the invention is not to be limited to the aforementioned details, but only by the appended claims and their equivalents.

What is claimed is:

1. A unit of a space conditioning system, said unit comprising:

a heat exchanger made of a predetermined first type of metal;

a cabinet with which said heat exchanger is mounted, said cabinet being made of a second type of metal different from said first type of metal, said cabinet having a top panel and a bottom panel;

a first plurality of snap-fit plastic members spaced along a top part of said heat exchanger to prevent contact between said heat exchanger and said top panel; and a second plurality of snap-fit plastic members spaced along a bottom part of said heat exchanger to prevent contact between said heat exchanger and said bottom panel.

2. The unit of claim 1 further including at least one mounting bracket made of said first type of metal and located on at least one end of said heat exchanger, said unit further including an attachment member for attaching said mounting bracket to said cabinet, whereby said heat exchanger is mounted with said cabinet, said attachment member being made of said second type of metal, said unit further including a non-metallic member interposed between said mounting bracket and said attachment member to prevent contact therebetween.

3. The unit of claim 2 wherein said non-metallic member includes at least one plastic bushing, said mounting bracket having aligned holes through which said bushing extends, said bushing being adapted to receive said attachment member therethrough, whereby said attachment member extends through said aligned holes inside said bushing without contacting said mounting bracket.

4. The unit of claim 3 wherein said non-metallic member includes two plastic bushings, each of which extends through one of said aligned holes, each bushing having a radially enlarged portion in contact with said mounting bracket proximate to each hole to isolate said mounting bracket from a portion of said cabinet with which said mounting bracket is mounted.

5. The unit of claim 4 wherein said mounting bracket has a semi-cylindrical portion in partial overlapping contact with at least one end of said heat exchanger and first and second ears extending from said semi-cylindrical portion, said ears having respective first and second aligned holes, one of said plastic bushings extending through said first aligned hole and the other one of said plastic bushings extending through said second aligned hole.

6. The unit of claim 1 wherein said first type of metal is aluminum and said second of metal is steel.

7. A unit of a space conditioning system, said unit comprising:

a heat exchanger made of a predetermined first type of metal;

a cabinet with which said heat exchanger is mounted, said cabinet being made of a second type of metal different from said first type of metal;

at least one first non-metallic member located on a top part of said heat exchanger to prevent contact between said heat exchanger and a top part of said cabinet;

at least one second non-metallic member located on a bottom part of said heat exchanger to prevent contact between said heat exchanger and a bottom part of said cabinet;

at least one mounting bracket made of said first type of metal and located on at least one end of said heat exchanger;

at least one attachment member used to mount said heat exchanger with said cabinet; and at least one third non-metallic member interposed between said mounting bracket and said attachment member to prevent contact therebetween.

8. The unit of claim 7 wherein said at least one third non-metallic member includes at least one non-metallic bushing, said bracket having aligned holes through which said bushing extends, said bushing being adapted to receive said attachment member therethrough, whereby said attachment member extends through said aligned holes in said bushing without contacting said bracket.

9. The unit of claim 8 wherein said at least one non-metallic bushing is comprised of two plastic bushings, each of which extends through one of said holes, each bushing having a radially enlarged portion in contact with said bracket proximate to a corresponding hole to isolate said bracket from a portion of said cabinet to which said bracket is mounted.

10. The unit of claim 9 wherein said bracket has a semi-cylindrical portion in partial overlapping contact with said at least one end of said heat exchanger and first and second ears extending from said semi-cylindrical portion, said first and second ears having respective first and second aligned holes, one of said plastic bushings extending rough said first aligned hole and the other one of said plastic bushings extending through said second aligned hole.

11. The unit of claim 7 wherein said first type of metal is aluminum and said second type of metal is steel.

* * * * *